US005080068A

United States Patent [19]

Sawamoto

[11] Patent Number: 5,080,068

[45] Date of Patent: Jan. 14, 1992

[54] FUEL SUPPLY CONTROL SYSTEM FOR INTERNAL COMBUSTION ENGINE

[75] Inventor: Kunifumi Sawamoto, Kanagawa, Japan

[73] Assignee: Nissan Motor Co., Ltd., Japan

[21] Appl. No.: 689,434

[22] Filed: Apr. 23, 1991

[30] Foreign Application Priority Data

May 31, 1990 [JP] Japan ..... 2-57808[U]

[51] Int. Cl.[5] ..... F02M 51/00; F02D 41/22; F02D 41/40

[52] U.S. Cl. ..... 123/435; 123/481

[58] Field of Search ..... 123/198 DB, 198 F, 425, 123/435, 479, 481, 630

[56] References Cited

U.S. PATENT DOCUMENTS

| | | | |
|---|---|---|---|
| 4,556,030 | 12/1985 | Aono | 123/435 X |
| 4,905,649 | 3/1990 | Washino et al. | 123/435 |
| 4,928,653 | 5/1990 | Ohkubo et al. | 123/435 |
| 4,979,481 | 12/1990 | Shimomura et al. | 123/481 |
| 4,984,546 | 1/1991 | Shimomura et al. | 123/435 X |

FOREIGN PATENT DOCUMENTS

| | | | |
|---|---|---|---|
| 0107826 | 6/1983 | Japan | 123/435 |
| 0103965 | 6/1984 | Japan | 123/435 |
| 63-75354 | 4/1988 | Japan . | |
| 63-97873 | 4/1988 | Japan . | |

*Primary Examiner*—Willis R. Wolfe

*Attorney, Agent, or Firm*—Lowe, Price, LeBlanc & Becker

[57] ABSTRACT

Disclosed herein is a fuel supply control system for an internal combustion engine. The system comprises a fuel supply member for supplying fuel to each cylinder of the engine; a pressure sensor which outputs a signal representative of an internal pressure of each cylinder under compression stroke; a crankangle sensor which outputs two types of signals, one being a signal which is issued each time a crankshaft of the engine rotates by a given angle, and the other being a signal which is issued each time the crankshaft comes to a given angular position; a pre-ignition judging device for judging whether a pre-ignition occurs or not in each cylinder based on the signals from the pressure sensor and the crankangle sensor; and a fuel supply stop device for stopping the fuel supply to a cylinder when the pre-ignition judging device judges that the cylinder encounters the pre-ignition.

5 Claims, 3 Drawing Sheets

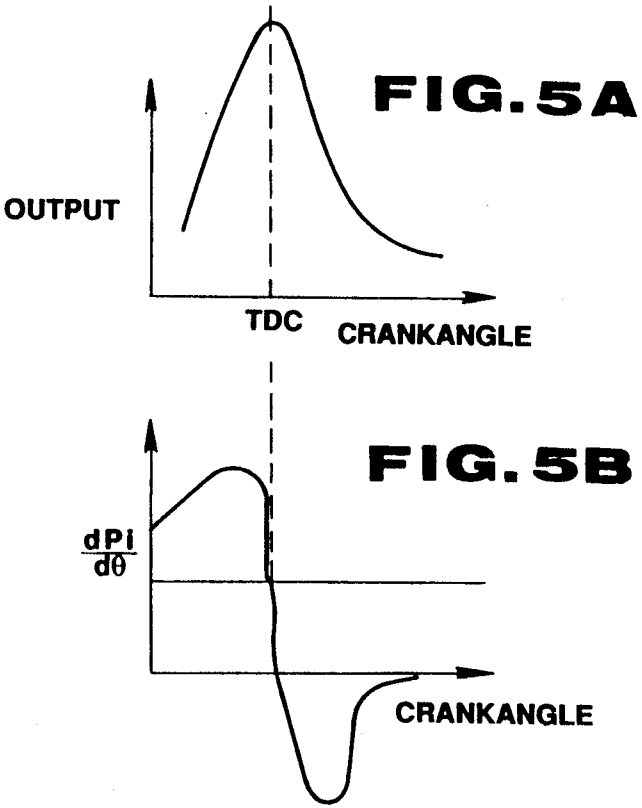
FIG. 5A
FIG. 5B
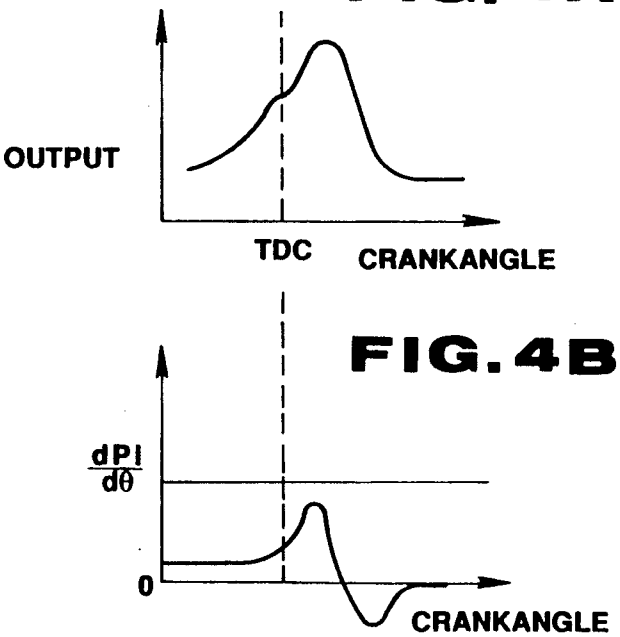
FIG. 4A
FIG. 4B

FUEL SUPPLY CONTROL SYSTEM FOR INTERNAL COMBUSTION ENGINE

BACKGROUND OF THE INVENTION

1. Field of the Invention

The present invention relates in general to control systems for controlling internal combustion engines, and more particularly, to control systems of a type which controls the fuel supply to the engine.

2. Description of the Prior Art

As is well known, when the engine is subjected to knocking, the output of the engine is lowered. Under this knocking condition, the con'rod bearings and main bearings are applied with abnormally high load due to the impactive pressure change in the cylinders. Furthermore, the knocking sometimes induces a seizure of pistons and valves due to high heat and pressure wave caused by the knocking.

In order to eliminate the problems caused by the knocking, various attempts have been hitherto made, which are, for example, delaying the ignition timing, enriching the air-fuel mixture and the like by sensing a high frequency vibration distinctively generated by the knocking. Some of these attempts are shown in Japanese Patent First Provisional Publications Nos. 63-97873 and 63-75354.

In addition to the knocking, "pre-ignition" is also the cause of lowering the output of the engine. As is known, the pre-ignition is an undesired phenomenon wherein due to a heat spot produced on an inner wall of a combustion chamber, the air-fuel mixture is overheated and thus ignited before the high tension ignition.

However, unlike knocking, in case of pre-ignition, the high frequency vibration is not produced. Thus, sensing the pre-ignition is much difficult as compared with sensing the knocking. Thus, hitherto, it has sometimes occurred that due to the pre-ignition, the durability of the engine is remarkably lowered.

SUMMARY OF THE INVENTION

It is therefore an object of the present invention to provide a fuel supply system for an internal combustion engine, which is free of the above-mentioned drawbacks.

According to the present invention, there is provided a fuel supply system for an internal combustion engine, which, by treating an output of a pressure sensor installed in each cylinder, judges whether a pre-ignition has occurred or not, and stops the fuel supply to the cylinder which has been subjected to the pre-ignition.

According to the present invention, there is provided a fuel supply control system for an internal combustion engine, which comprises a fuel supply means for supplying fuel to each cylinder of the engine; a pressure sensor which outputs a signal representative of an internal pressure of each cylinder under compression stroke; a crankangle sensor which outputs two types of signals, one being a signal which is issued each time a crankshaft of the engine rotates by a given angle, and the other being a signal which is issued each time the crankshaft comes to a given angular position; a pre-ignition judging means for judging whether a pre-ignition occurs or not in each cylinder based on the signals from the pressure sensor and the crankangle sensor; and fuel supply stop means for stopping the fuel supply to a cylinder when the pre-ignition judging means judges that the cylinder encounters the pre-ignition.

BRIEF DESCRIPTION OF THE DRAWINGS

Other objects and advantages of the present invention will become apparent from the following description when taken in conjunction. with the accompanying drawings, in which:

FIGS. 4A, 4B, 5A and 5B are graphs showing output and pressure gradient of each cylinder with respect to the crankangle of an internal combustion engine.

DETAILED DESCRIPTION OF THE INVENTION

Figure 1:
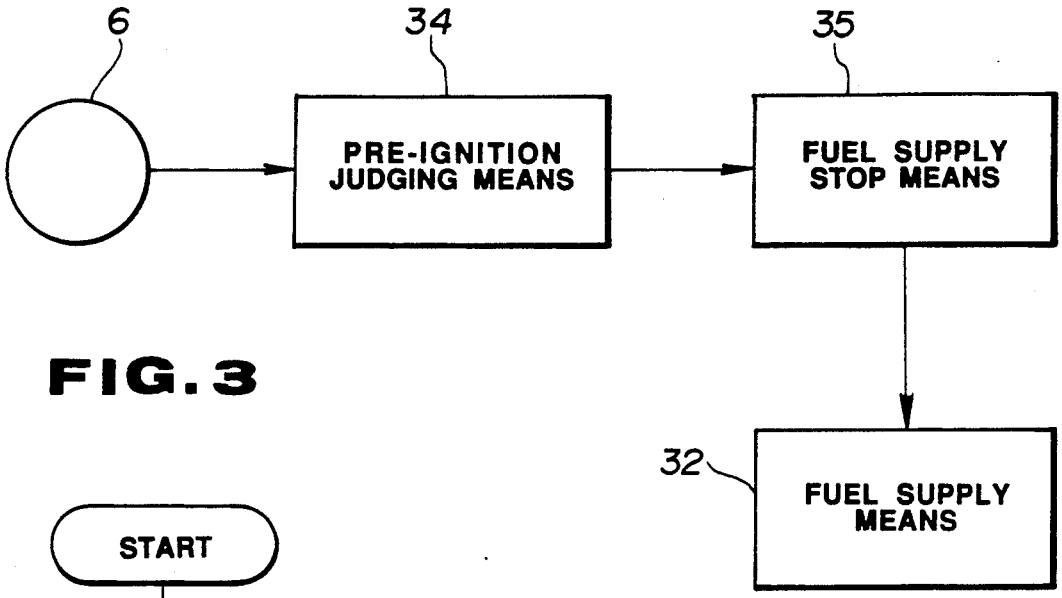
FIG. 1 is a conceptual diagram showing the present invention.
Figure 2:
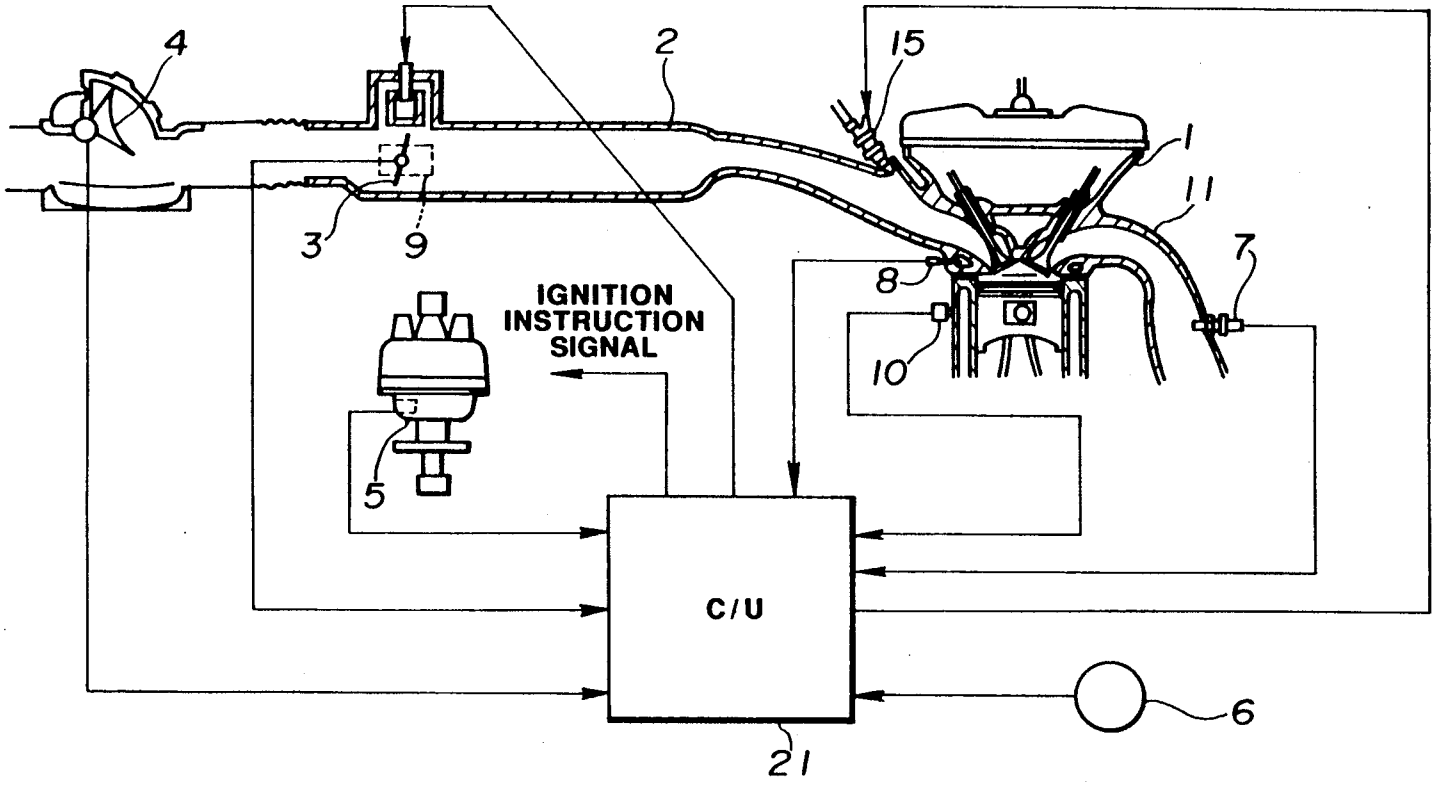
FIG. 2 is a system diagram of the present invention.

Referring to FIGS. 1 and 2, particularly FIG. 2, there is shown a system diagram schematically showing the present invention.

In the drawing, designated by numeral 1 is an internal combustion 1 which has an air intake conduit 2. The air intake conduit 2 has a throttle valve 3 installed therein. An air-flow meter 4 is mounted to the air intake conduit 2 at a position upstream of the throttle valve 3. The air-flow meter 4 outputs a signal representative of the amount of air practically fed to the engine 1. This signal will be referred to as "air amount representing signal" hereinafter.

Designated by numeral 5 is a crankangle sensor which outputs a signal each time the crankshaft rotates by a given angle as well as a signal each time the crankshaft comes to a given angular position. The former signal is used for measuring the engine rotation speed, while the latter signal is used for judging whether each cylinder is under compression stroke or not.

Designated by numeral 21 is a control unit which includes a computer, to which the signals from the air-flow meter 4 and the crankangle sensor 5 are fed.

Designated by numeral 6 is a pressure sensor which is installed in each cylinder of the engine 1 to sense the internal pressure "P" of the corresponding combustion chamber. Preferably, the pressure sensor 6 is mounted to an ignition plug.

Designated by numeral 7 is an oxygen sensor installed in an exhaust conduit 11 of the engine, which senses the amount of oxygen in the exhaust gas. Designated by numeral 8 is a water temperature sensor which senses the temperature of cooling water flowing in the water jacket of the engine 1. Designated by numeral 9 is a throttle opening degree sensor which senses the opening degree of the throttle valve 3. Designated by numeral 10 is a knocking sensor which senses the knocking of the engine 1.

The signals from these sensors 6 to 10 are also fed to the control unit 21.

At the control unit 21, optimum ignition timing for each cylinder is derived, and the amount of fuel required for each combustion cycle is calculated by studying the signals from the sensors. Based on the calculation, the control unit 21 issues an instruction signal to each fuel injector 15 to control the same to feed the corresponding cylinder with the calculated amount of fuel. The fuel injector 15 is of an electromagnetically control type. Either simultaneous fuel injection to all cylinders or sequential fuel injection to cylinders may be employed by the fuel injectors 15.

It is to be noted that the fuel injectors 15 constitute a fuel supply means 32 shown in the conceptual diagram of FIG. 1.

At the control unit 21, the following operation is also carried out for achieving a so-called "fail safe".

Figure 3:
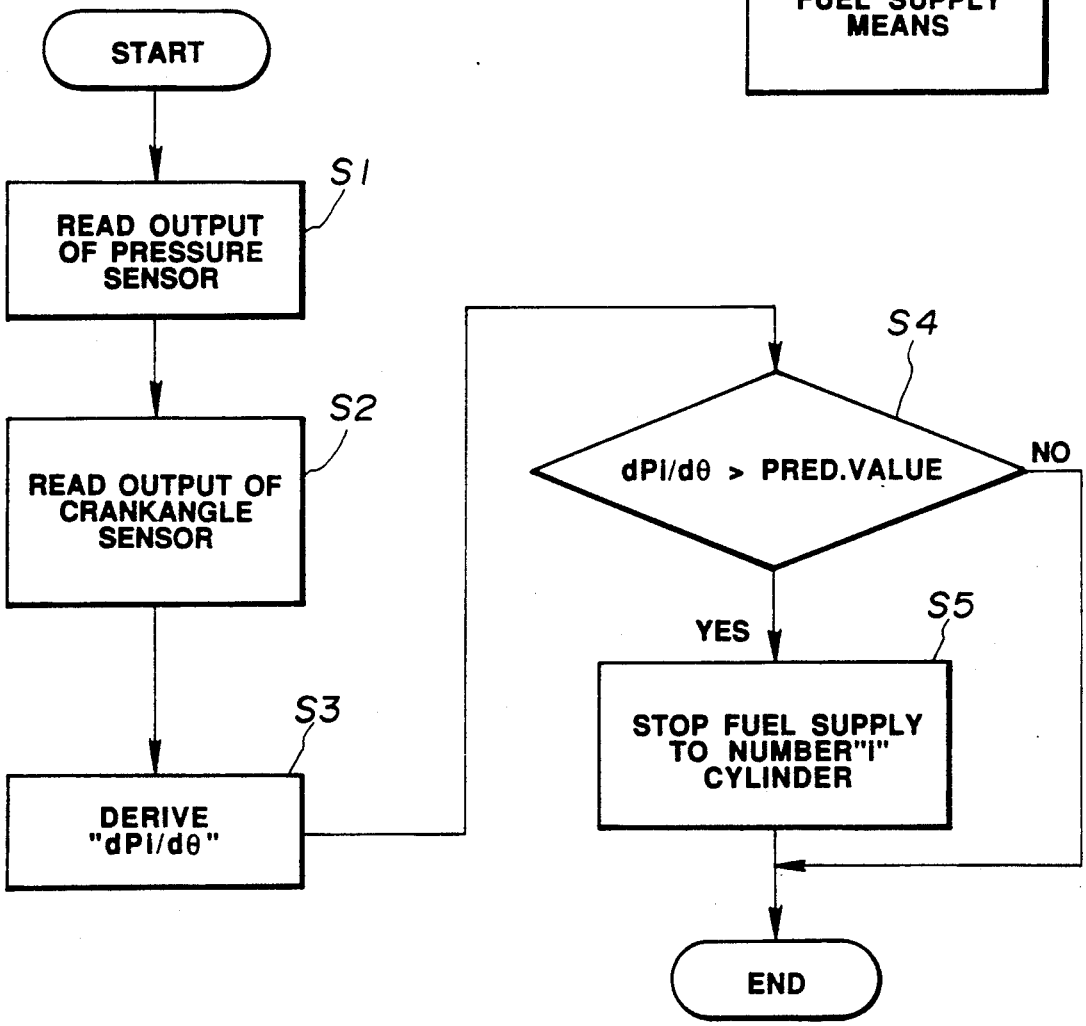
FIG. 3 is a flowchart showing operation steps programmed in a computer employed in the invention.

FIG. 3 shows a routine carried out by the control unit 21 for each cylinder.

At step S1, an output "Pi" of the pressure sensor 6 installed in the number "i" cylinder ("i" indicates the cylinder-number) is sampled at regular intervals of time and read.

At step S2, the two signals from the crankangle sensor 5 are read.

At step S3, using the output "Pi" from the pressure sensor 6 of the number "i" cylinder and the crankangle signal "$\theta$" from the crankangle sensor 5, a pressure gradient "$dPi/d\theta$" in the number "i" cylinder during its compression stroke is calculated.

It is to be noted that during a combustion stroke of the engine 1, distinction between the knocking and the pre-ignition is very difficult. Thus, in the present invention, the calculation of the pressure gradient "$dPi/d\theta$" is directed to only the compression stroke.

At step S4, a comparison between the calculated pressure gradient "$dPi/d\theta$" and a predetermined value is carried out.

That is, when the calculated pressure gradient "$dPi/d\theta$" is greater than the predetermined value, it is judged that there has been a pre-ignition in the number "i" cylinder. Upon this, the operation flow comes to step S5. While, when the pressure gradient is smaller than the predetermined value, it is judged that there has not been a pre-ignition in the cylinder. Upon this, the operation flow comes to the end.

The judgement as to whether a pre-ignition has taken place in the cylinder or not is based on the following fact.

That is, when a pre-ignition occurs, a violent pressure increase takes place prior to the compression of top dead center (TDC), and thus, if the pressure change (viz., pressure gradient "$dPi/d\theta$") during the compression stroke is violent, it can be judged that there has been a pre-ignition in the cylinder.

It is to be noted that the steps S3 and S4 are functions possessed by a pre-ignition judging means 34 shown in the conceptual diagram of FIG. 1.

At step S5, the fuel supply to the number "i" cylinder is stopped.

When the above-mentioned operation is finished at the number "i" cylinder, identical operation follows at the other cylinders in order.

The above-mentioned programmed operation flow will be much clarified from the following description.

When, for example, the number "i" cylinder operates normally without suffering a pre-ignition, the peak of output appears at a position behind the compression top dead center (TDC) by a predetermined crankangle, as is shown in the graph of FIG. 4A. Under this condition, the pressure increase appearing prior to the compression top dead center (TDC) is relatively gentle, and thus, the pressure gradient "$dPi/d\theta$" in the number "i" cylinder during its compression stroke does not exceed the predetermined value, as shown in the graph of FIG. 4B.

However, when the number "i" cylinder is subjected to a pre-ignition, the output shows its maximum value at the compression top dead center (TDC), as is shown in the graph of FIG. 5A. Furthermore, upon this, the pressure change during the compression stroke becomes violent. Thus, the pressure gradient "$dPi/d\theta$" exceeds the predetermined value, as is shown in the graph of FIG. 5B.

With this exceed of the pressure gradient, it can be judged that the number "i" cylinder has encountered a pre-ignition. Thus, the fuel supply to the number "i" cylinder by the corresponding fuel injector 15 is stopped for a given period of time.

Thus, thereafter, the cylinder which has encountered a pre-ignition does not effect the combustion. Thus, the undesired heat spot produced in the number "i" cylinder is sufficiently cooled with an aid of the cooling water in the water jacket. Thus, the pre-ignition does not continue.

As will be understood from the above description, in the present invention, the judgement as to whether a pre-ignition occurs or not is carried out based on the pressure gradient "$dPi/d\theta$" during the compression stroke of the corresponding cylinder.

What is claimed is:

1. A fuel supply control system for an internal combustion engine, comprising:

a fuel supply means for supplying fuel to each cylinder of the engine;

a pressure sensor which outputs a signal representative of an internal pressure of each cylinder under compression stroke;

a crankangle sensor which outputs two types of signals, one being a signal which is issued each time a crankshaft of the engine rotates by a given angle, and the other being a signal which is issued each time the crankshaft comes to a given angular position;

pre-ignition judging means for judging whether a pre-ignition occurs or not in each cylinder based on the signals from said pressure sensor and said crankangle sensor; and fuel supply stop means for stopping the fuel supply to a cylinder when said pre-ignition judging means judges that the cylinder encounters the pre-ignition.

2. A fuel supply control system as claimed in claim 1, in which said pre-ignition judging means comprises:

means for deriving a pressure gradient in a cylinder during its compression stroke by treating the signals from said pressure sensor and said crankangle sensor; and means for comparing said pressure gradient with a predetermined value and actuating said fuel supply stop means to stop said fuel supply when said pressure gradient is greater than said predetermined value.

3. A fuel supply control system as claimed in claim 2, in which said fuel supply means comprises an electromagnetically controlled fuel injector.

4. A fuel supply control system as claimed in claim 3, in which the operations of said pre-ignition judging means and said fuel supply stop means are carried out in a computer-installed control unit.

5. A fuel supply control system as claimed in claim 4, further comprising:

sensor means for sensing the throttle valve opening degree of the engine, the amount of air practically fed to said engine, the oxygen concentration in exhaust gas, the temperature of cooling water in water jacket of the engine and the knocking condition of the engine; and means for controlling an ignition timing of each cylinder by treating the outputs from said sensor means.

* * * * *